US006913270B2

(12) United States Patent
Wang

(10) Patent No.: US 6,913,270 B2
(45) Date of Patent: Jul. 5, 2005

(54) ROLLER SKATE SHOE

(76) Inventor: Kuo-Hua Wang, P.O. Box No. 6-57, Junghe, Taipei (TW), 235

( * ) Notice: Subject to any disclaimer, the term of this patent is extended or adjusted under 35 U.S.C. 154(b) by 135 days.

(21) Appl. No.: 10/461,486

(22) Filed: Jun. 16, 2003

(65) Prior Publication Data

US 2004/0251644 A1 Dec. 16, 2004

(51) Int. Cl.[7] ..... A63C 17/08
(52) U.S. Cl. ..... 280/11.24; 280/11.27
(58) Field of Search ..... 280/11.19, 11.24, 280/11.26, 11.27, 11.28, 841, 11.226, 11.232, 11.223, 7.12, 7.13

(56) References Cited

U.S. PATENT DOCUMENTS 6,364,322 B1 * 4/2002 Lee ..... 280/11.27
6,394,468 B1 * 5/2002 Chiang et al. ..... 280/11.223
6,450,508 B1 * 9/2002 Chu ..... 280/11.208
6,536,785 B2 * 3/2003 Lee ..... 280/11.27
6,629,698 B2 * 10/2003 Chu ..... 280/11.19
6,739,602 B2 * 5/2004 Adams ..... 280/11.19

* cited by examiner

*Primary Examiner*—Christopher P. Ellis
*Assistant Examiner*—Brian Swenson

(57) ABSTRACT

A roller skate shoe includes a shoe body and a roller mechanism. The roller mechanism is consisted of a housing, a roller, a roller axis, press rods, elastic members and a butting assembly. An accommodating chamber is disposed below a rear end of an insole of a shoe body, and the rear end of the insole is disposed with an insertion opening penetrating a rear end of the accommodating chamber, thereby placing the roller mechanism in the accommodating chamber. To put the aforesaid structure in use, the roller is extended or retracted through actions of the butting assembly and the elastic members of the roller mechanism, thereby providing a user with choices of using the roller skate shoe for skating or walking.

2 Claims, 5 Drawing Sheets

ROLLER SKATE SHOE

BACKGROUND OF THE INVENTION (a) Field of the Invention

The invention relates to a roller skate shoe, and more particularly, to a roller skate shoe having a roller mechanism at a bottom portion of a shoe body thereof, thereby providing a user with a multi-functional roller skate shoe for walking or for roller skate on the ground using a roller thereof.

(b) Description of the Prior Art

A prior roller skate shoe is pivotally disposed with a plurality of rollers at a bottom portion of the shoe, so that a user is enabled to roller skate on the ground when wearing the roller skate shoe.

However, according to the aforesaid structure, the rollers of the roller skate shoe lack extendable and retractable functions, and therefore, apart from skating, a user wearing the shoe is incapable of selectively walking on landscapes unsuitable for skating. The aforesaid structure is limited with respect to practicability thereof.

There is a type of roller skate shoe having extendable and retractable functions available on the market. A bottom portion of a shoe body thereof is additionally provided with an extendable mechanism, press rods and springs. Rollers thereof are collapsed and retracted through the extendable mechanism and the springs, and hence a user is allowed to store the rollers for walking. However, when using the roller skate shoe, a user is obligated to squat first in order to pull the extendable mechanism using forces imposed by hands to further collapse and retract the rollers, and operations thereof are resulted as rather inconvenient.

SUMMARY OF THE INVENTION

The primary object of the invention is to provide a roller skate shoe, wherein an accommodating chamber is disposed below a rear end of an insole of a shoe body thereof, so as to place a roller mechanism in the accommodating chamber, thereby providing a multi-functional roller skate shoe for a user to selectively walk on the ground, or skate on the ground using a roller body thereof.

The secondary object of the invention is to provide a roller skate shoe, wherein, without using manual operations of a user, a push button protruding from a rear end of the insole is pressed against a wall or other objects for controlling ascending and descending of the roller, thereby facilitating operations of the entire structure.

To accomplish the aforesaid objects, the invention comprises a shoe body and a roller mechanism at a bottom portion of the shoe body. The roller mechanism is consisted of a housing, a roller, a roller axis, press rods, elastic members and a butting assembly. An accommodating chamber is disposed below a rear end of an insole of the shoe body, so as to place the roller mechanism in the accommodating chamber to further complete skating by having the roller mechanism come into direct contact with the ground.

To use the invention for skating, a push button of the butting assembly is pressed for projecting the roller in the roller mechanism to come into contact with the ground for skating. To use the invention for walking, the push button of the butting assembly is similarly pressed with application of downward force upon the shoe body, so as to restore the shoe body back into the accommodating chamber.

DETAILED DESCRIPTION OF THE PREFERRED EMBODIMENTS

To better understand the structure and characteristics of the invention, detailed descriptions shall be given with the accompany drawings hereunder.

Figure 1:
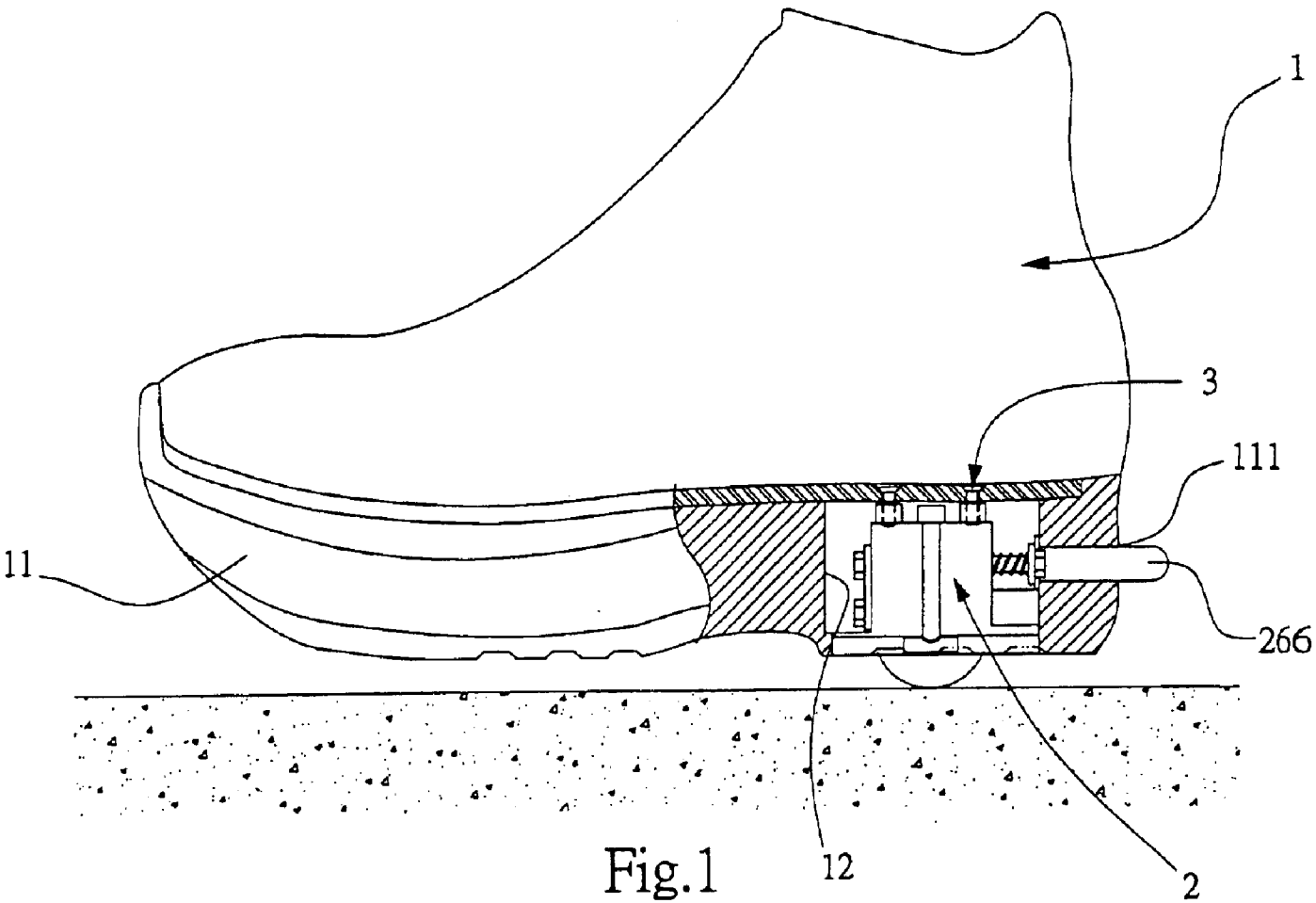
FIG. 1 shows a side view according to the invention.
Figure 2:
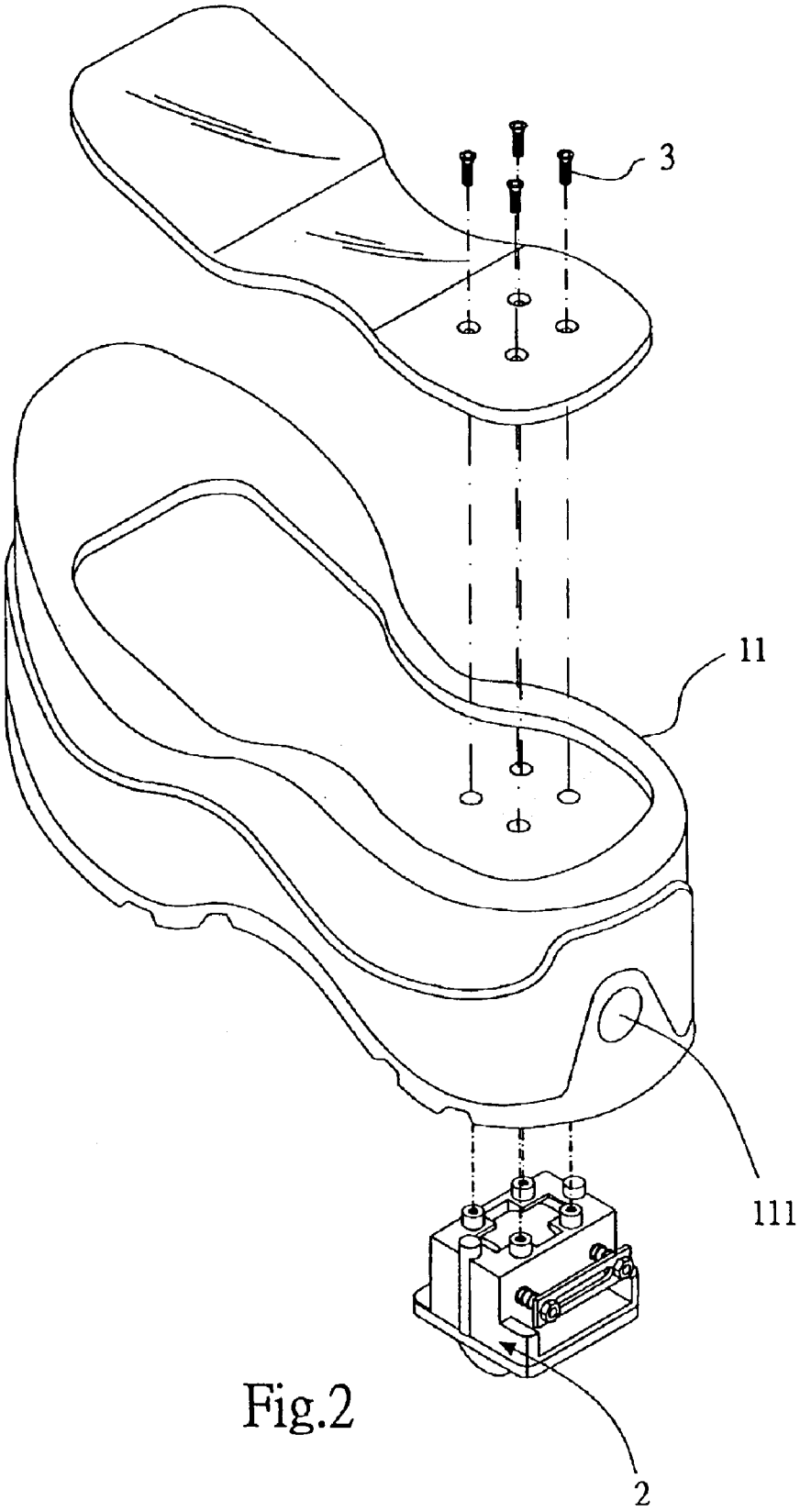
FIG. 2 shows a partial exploded elevational view according to the invention.
Figure 3:
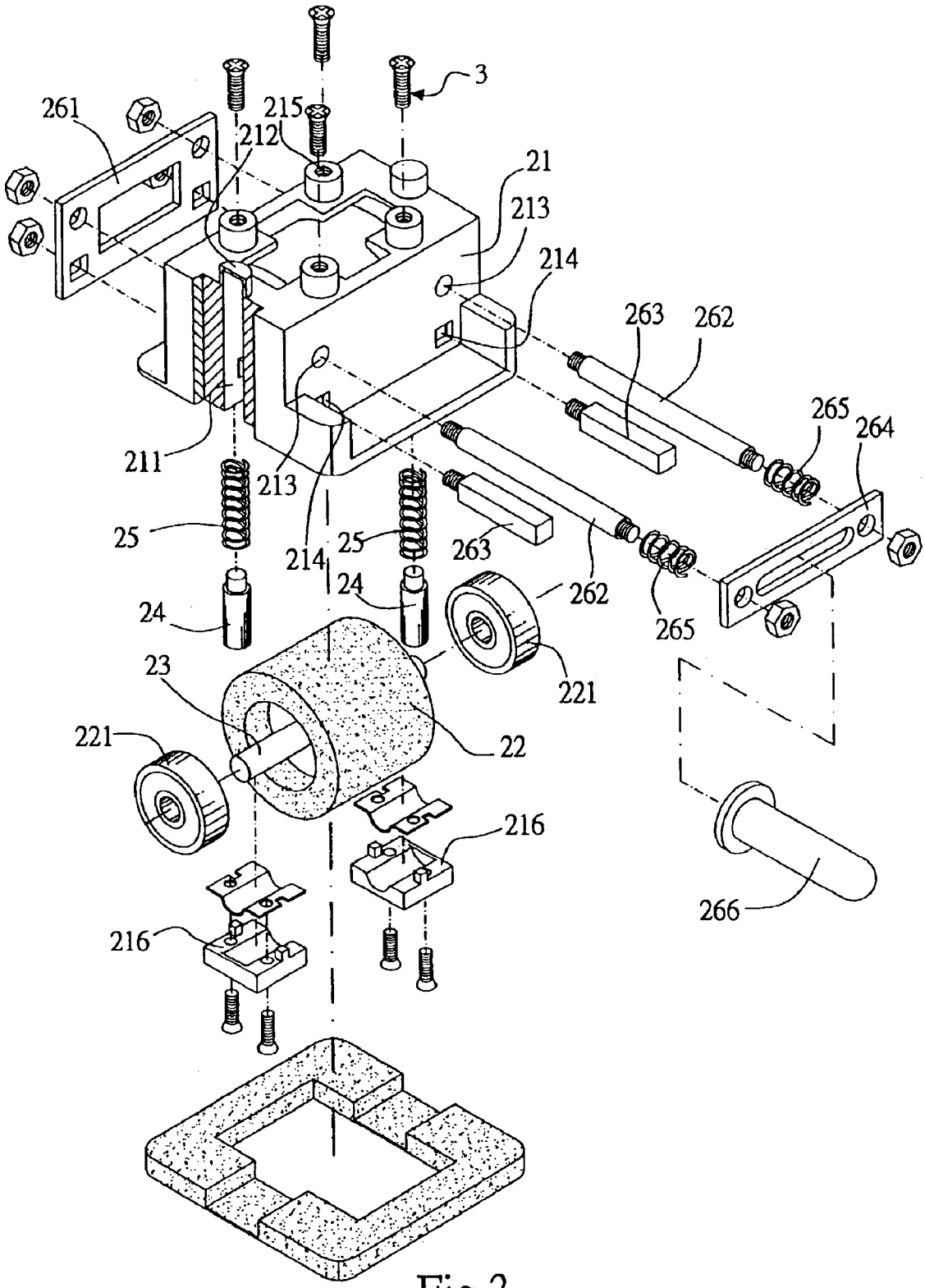
FIG. 3 shows an exploded elevational view of the roller mechanism according to the invention.

Referring to FIGS. 1 to 3, the invention comprises a shoe body 1 and a roller mechanism 2.

The body 1 is provided with an insole 11, and an accommodating chamber 12 below a rear portion of the insole 11. A rear end of the insole 11 is disposed with an insertion opening 111 penetrating a rear end of the accommodating chamber 112, and the roller mechanism 2 is placed in the accommodating chamber 112.

The roller mechanism 2 is consisted of a housing 21, a roller 22, a roller axis 23, press rods 24, elastic members 25 and a butting assembly 26.

The housing 21 having an accommodating room is provided with an axis slot 211 at bottom portions of left and right prop side walls, respectively; a fastening piece 216 at bottom ends of two sides of the housing 21 for enclosing openings of the axis slots 211, respectively, such that the roller axis 23 is able to perform vertical rolling movements in the axis slot 211; a top panel 212 disposed at top portions of the two axis slots 211, respectively; two pushing holes 213 and two butting holes 214 transversely penetrated through from a front prop wall to a rear prop wall thereof, and the butting holes 214 are also penetrated through bottom portions of the axis slots 211; a plurality of screw openings 215 at a top end thereof, such that screws 3 are inserted into the screw openings 215 at the housing 21 from a top end of the insole 11 for fastening the housing 21 in the accommodating chamber 12.

The roller 22 is placed in the accommodating room of the housing 21, and is disposed with a bearing 221 at two sides of an axis opening thereof, respectively. When the roller axis 23 is penetrated through the bearings 221, the roller 22 becomes capable of up-and-down movements along the axis slots 211 by placing two exposed ends of the roller axis 23 in the axis slots 211.

The butting assembly 26 is provided with a foundation board 261 at a front end of the housing 21. The foundation board 261 is fastened with a long pole 262 at two upper sides thereof, respectively, and a short pole 263 at lower sides thereof, respectively. The long poles 262 and the short poles 263 are corresponded with the pushing holes 213 and the butting holes 214 of the housing 21, respectively. The short poles 263 are inserted into the housing 21 at a length slightly longer than that of the axis slots 211, and the long poles 262 have a length longer than that of the pushing holes 213. Each of the long poles 262 is covered with a spring 265 when being penetrated through the each of the pushing holes 213, and a butting panel 264 is fastened using screw nuts, so as to dispose the butting assembly 26 at the housing 21 for transverse movements. A center at a rear end of the butting panel 264 of the butting assembly 26 is provided with a push button 266, which is penetrated through the insertion opening 111 of the accommodating chamber 12 at the insole 11 out to the exterior at a rear end of the insole 11.

The press rods 24 and the elastic members 25 are disposed in the axis slots 211 in sequence, so as to allow the press rods 24 with appropriate pressure for suppressing two ends of the roller axis 23 to move downward. In addition, the aforesaid elastic members 25 are compression resistant springs.

Figure 4:
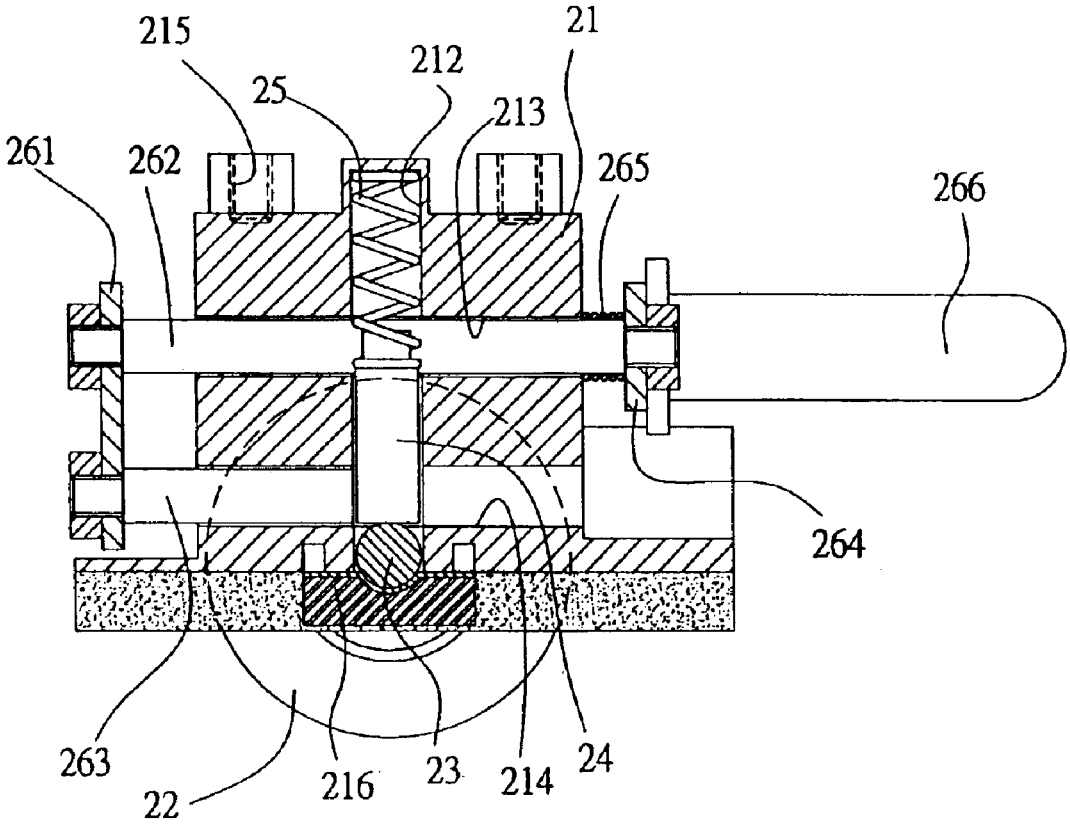
FIG. 4 shows a sectional view of the roller being descended according to the invention.
Figure 5:
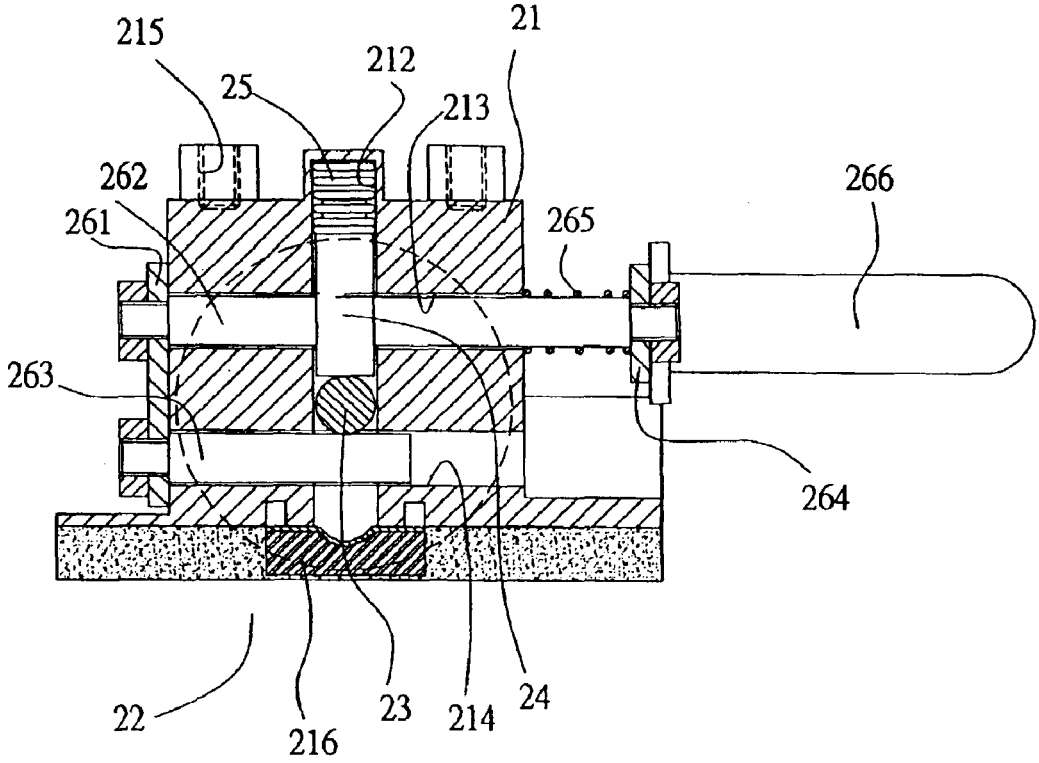
FIG. 5 shows a sectional view of the roller being ascended and stored according to the invention.

Referring to FIGS. 4 and 5, when a user intends to skate, an external force is applied for pressing the push button 266 of the butting assembly 26 to butt against the butting panel 264 and to further impel the foundation board 261 to move forward, thereby withdrawing the short poles 263 from the axis slots 211. At this point, the roller axis 23 originally situated above the short poles 263, supported by and pressed against the short poles 263 by pressure of the press rods 25 and the elastic members 25, are moved downward to bottom ends of the axis slots 211, such that the roller 22 becomes revealed out of the accommodating chamber 12 below the insole 11 to come into contact with the ground. After that, the push button 266 is released, and the butting assembly 26 restores back to an original position thereof due to action of the springs 265. In the meanwhile, the short poles 263 are again penetrated through the axis slots 211 to butt the roller axis 23 against the fastening pieces 216 below the roller axis 23 for positioning, thereby projecting the roller 22 below the insole 11 for skating on the ground.

When the user intends to use the structure for walking, the push button 266 at the rear end of the butting assembly 26 is pushed for moving the butting assembly 26 forward. At the time of the short poles 263 of the butting assembly 26 being withdrawing from the axis slots 211, a downward force is applied toward the ground for forcing the roller axis 23 to move upward along the axis slots 211, thereby placing the roller 22 into the accommodating chamber 12 below the insole 11. The push button 266 is then released, such that the short poles 263 of the butting assembly 26 are restored back positions before penetrating through the axis slots 211 to support the roller axis 23 above the short poles 263, thereby facilitating walking by preventing the roller 22 from coming into contact with the ground.

In connection with the aforesaid description, when a user operates the structure according to the invention, manipulations of the structure are facilitated by merely pressing the push button at the rear end of the insole toward a wall, another heel of the user, or other objects.

Conclusive from the above, the structure according to the invention has simple operations for facilitating walking or skating purposes. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A roller skate shoe comprising a shoe body and a roller mechanism, and being characterized that:

the shoe body is provided with an accommodating chamber below a rear portion of an insole thereof; a rear end of the insole is disposed with an insertion opening penetrating a rear end of the accommodating chamber; and the roller mechanism is placed in the accommodating chamber; and the roller mechanism is consisted of a housing, a roller, a roller axis, press rods, elastic members and a butting assembly; wherein:

the housing having an accommodating room is provided with an axis slot at bottom portions of left and right prop side walls thereof, respectively; a fastening piece at bottom ends of two sides of the frame for enclosing openings of the axis slots, respectively, such that the roller axis is able to perform vertical rolling movements in the axis slot; a top panel disposed at top portions of the two axis slots, respectively; two pushing holes and two butting holes transversely penetrated through from a front prop wall to a rear prop wall thereof, and the butting holes are also penetrated through bottom portions of the axis slots; a plurality of screw openings at a top end thereof, such that screws are inserted into the screw openings at the housing from a top end of the insole for fastening the housing in the accommodating chamber;

the roller is placed in the accommodating room of the housing, and is disposed with a bearing at two sides of an axis opening thereof, respectively; and when the roller axis is penetrated through the bearings, the roller becomes capable of up-and-down movements along the axis slots by placing two exposed ends of the roller axis in the axis slots;

the butting assembly is provided with a foundation board at a front end of the housing; the foundation board is fastened with a long pole at two upper sides thereof, respectively, and a short pole at lower sides thereof, respectively; the long poles and the short poles are corresponded with the pushing holes and the butting holes of the housing, respectively; the short poles are inserted into the housing at a length slightly longer than that of the axis slots, and the long poles have a length longer than that of the pushing holes; each of the long poles is covered with a spring when being penetrated through the each of the pushing holes, and a butting panel is fastened using screw nuts, thereby disposing the butting assembly at the housing for transverse movements; and a center at a rear end of the butting panel of the butting assembly is provided with a push button, which is penetrated through the insertion opening of the accommodating chamber at the insole out to the exterior at a rear end of the insole;

the press rods and the elastic members are disposed in the axis slots in sequence, so as to allow the press rods with appropriate pressure for suppressing two ends of the roller axis to move downward; and an external force is applied for pressing the push button of the butting assembly to withdraw the short poles out of the axis slots, thereby manipulating the roller to reveal from a bottom end of the shoe or to retract.

2. The roller skate shoe in accordance with claim 1, wherein the elastic members are compression resistant springs.

* * * * *